United States Patent [19]

Ogi et al.

[11] Patent Number: 4,910,130

[45] Date of Patent: Mar. 20, 1990

[54] DIRECT POSITIVE LIGHT-SENSITIVE SILVER HALIDE PHOTOGRAPHIC MATERIAL

[75] Inventors: Keiji Ogi; Atushi Kamitakahara, both of Hino, Japan

[73] Assignee: Konica Corporation, Tokyo, Japan

[21] Appl. No.: 123,968

[22] Filed: Nov. 23, 1987

[30] Foreign Application Priority Data

Nov. 25, 1986 [JP] Japan ..... 61-280165

[51] Int. Cl.[4] ..... G03C 1/36

[52] U.S. Cl. ..... 430/606; 430/567; 430/598

[58] Field of Search ..... 430/606, 598, 567, 509

[56] References Cited

U.S. PATENT DOCUMENTS

| | | | |
|---|---|---|---|
| 2,497,875 | 2/1950 | Fallesen . | |
| 2,588,982 | 3/1952 | Ives . | |
| 2,592,250 | 4/1952 | Davey et al. . | |
| 3,761,266 | 9/1973 | Milton . | |
| 3,761,276 | 9/1973 | Evans . | |
| 3,796,577 | 3/1974 | Collier et al. . | |
| 3,935,014 | 1/1976 | Klotzer et al. . | |
| 3,957,488 | 5/1976 | Klotzer et al. . | |
| 4,035,185 | 7/1977 | Evans et al. . | |
| 4,477,561 | 10/1984 | Menjo et al. | 430/509 |
| 4,495,274 | 1/1985 | Yoshida | 430/606 |
| 4,613,563 | 9/1986 | Murai | 430/598 |
| 4,639,410 | 1/1987 | Mochizuki et al. | 430/509 |
| 4,666,827 | 5/1987 | Sumi et al. | 430/606 |

FOREIGN PATENT DOCUMENTS

| | | |
|---|---|---|
| 4512709 | 5/1970 | Japan . |
| 1150553 | 4/1969 | United Kingdom . |
| 1151363 | 5/1969 | United Kingdom . |

OTHER PUBLICATIONS

Research Disclosure 15162.
Research Disclosure 17643 (Dec. 1978).

*Primary Examiner*—Paul R. Michl
*Assistant Examiner*—Janet C. Baxter
*Attorney, Agent, or Firm*—Finnegan, Henderson, Farabow, Garrett and Dunner

[57] ABSTRACT

A direct positive light-sensitive silver halide photographic material having at least one silver halide emulsion layer containing at least two kinds of internal latent image type silver halide grains not previously fogged and having the same spectral sensitivity, and capable of obtaining a direct positive image by effecting surface development while applying and/or after applying overall exposure after imagewise exposure; wherein said at least two kinds of internal latent image type silver halide grains have different sensitivity from each other and at least one of silver halide grains having lower sensitivity is desensitized with use of an organic or inorganic desensitizer, and a method of use of the direct positive light-sensitive silver halide photographic material for carrying out development at a higher temperature.

26 Claims, No Drawings

DIRECT POSITIVE LIGHT-SENSITIVE SILVER HALIDE PHOTOGRAPHIC MATERIAL

BACKGROUND OF THE INVENTION

This invention relates to a direct positive light-sensitive silver halide photographic material, particularly, to a direct positive light-sensitive silver halide photographic material having a broad fogging exposure latitude, and also to a method of use of the same, particularly for carrying out development at a higher temperature.

In general, it is well known that a direct positive photographic image can be formed by using a light-sensitive silver halide photographic material (hereinafter merely called light-sensitive material) without requiring any intermediate processing steps or negative images.

Conventionally known methods used for forming a positive image with use of direct positive light-sensitive materials can be grouped into two types.

One type is a method in which, using a silver halide emulsion previously fogged, fog nuclei (latent images) of exposed portions are destroyed with utilization of the solarization or Herschel effect to obtain a positive image after developing.

Another type is a method in which, using an internal latent image type silver halide emulsion not previously fogged, the surface development is carried out after fogging treatment is applied, or while fogging treatment is applied, after imagewise exposure, to obtain a positive image.

The above internal latent image type silver halide photographic emulsion refers to a silver halide photographic emulsion that has sensitivity specks chiefly in the insides of silver halide grains so that latent images are formed in the insides of the grains when exposed to light.

The method of the latter type can provide a relatively higher sensitivity as compared with the method of the former type, and is suited for the application that requires a higher sensitivity. This invention particularly relates to the latter type.

Various techniques have been hitherto known in this technical field. For example, they chiefly include those described in U.S. Pat. No. 2,592,250, No. 2,466,957, No. 2,497,875, No. 2,588,982, No. 3,761,266, No. 3,761,276 and No. 3,796,577, and British Pat. No. 1,151,363, etc.

With use of these known methods, it is possible to produce light-sensitive photographic materials having a relatively higher sensitivity as the direct positive types.

With regard to the details of the mechanism by which the direct positive image is formed, any clear explanation can not be said to have been sufficiently made, but the process in which the positive image is formed can be understood to a certain extent, for example, from "Desensitization Action by Internal Latent Image" as discussed in Mees and James, The Theory of the Photographic Process, Third Edition, page 161.

More specifically, it can be presumed that owing to the surface desensitization action caused by the so-called internal latent images produced in the insides of silver halide grains by the initial image exposure, fog nuclei are selectively formed only on the surfaces of unexposed silver halide grains, and subsequently a photographic image is formed on the unexposed portions by the usual development.

As a means for selectively forming the fog nuclei, there are known a method called the light fogging (fogging by light) in which the fogging is effected over the whole area of a light-sensitive layer by exposing to light, and a method called chemical fogging in which the fogging is effected by use of an agent such as a fogging agent.

Of such methods, the chemical fogging method is disadvantageous in that it involves a severe condition such that the effect of the fogging agent can be obtained for the first time at a high pH value of pH 12 or more, so that there tends to occur the deterioration of the fogging agent owing to air oxidation to extremely lower the fogging effect.

On the other hand, in the case of the light fogging method, it involves no such severe condition as mentioned above, and is practically convenient. However, there remains technical problems in using it for various purposes in a comprehensive photographic field. Namely, since the light fogging method is based on the formation of fog nuclei by virtue of the photolysis of silver halide, its correct exposure irradiance or exposure amount may vary depending on the kind or properties of silver halide.

For example, Japanese Patent Publication No. 12709/1970 discloses a method of uniformly exposing overall area with use of low-intensity light. It teaches that a good positive image having a high maximum density and a low minimum density can be obtained by subjecting the overall area to lower irradiance exposure.

It has been also revealed as a result of the studies made by the present inventors, that in order to obtain a relatively good positive image, it is necessary to apply fogging exposure of a relatively low irradiance within a certain range of intensity. Thus, no sufficient maximum image density can be obtained with an irradiance lower than this range even if a sufficient exposure is applied, and also, with an irradiance higher than this range, there may occur a phenomenon that the maximum density decreases and the minimum density increases in proportion to intensity, which is so-called intensity reciprocity failure in light fogging.

Accordingly, it is desirable to control intensity and time for the overall uniform exposure by suitably changing them depending on the internal latent image type light-sensitive materials, development processing conditions and types of light sources to be used, so as to obtain a best positive image.

It is also possible to form a positive image of low contrast with use of the internal latent image type direct positive light-sensitive material. In this instance, it is well known to mix silver halide grains of different sensitivity or to laminate silver halide emulsion layers of different sensitivity in order to control the gradation.

For example, Research Disclosure (hereinafter abbreviated as R.D.) No. 15162 and U.S. Pat. No. 4,035,185 disclose that, in addition to mixing of silver halide grains having different grain sizes, silver halide grains having approximately the same grain sizes but different sensitivities or different gradations are mixed to control the gradation.

However, from our extensive studies, it was revealed that since the silver halide grains having different sensitivity from each other are also different in not only the sensitivity at the time of image formation but also the sensitivity to the overall exposure at the time of light fogging, the optimum conditions (or the optimum exposure range) for each overall exposure may also become different, and therefore, light-sensitive photographic materials in which silver halide grains having different sensitivity from each other are combined, has characteristics that the optimum exposure range may become narrower depending on its combination since the overlapped exposure region of each silver halide grains only can be the optimum exposure range.

However, descriptions as to the characteristics described above can not be found at all in the above R.D. No. 15162 and U.S. Pat. No. 4,035,185.

As a result of further studies on the above, it became clear that the above property is remarkable when the development processing is carried out at a high temperature, particularly at 30° C. or more, and thus it was revealed that practical problems may arise in such an occasion. More specifically, it was revealed that when a internal latent image type light-sensitive material containing two or more kinds of silver halide grains having different sensitivity are subjected to overall exposure to apply light fogging and development processing (particularly at 30° C. or more) is carried out, if a local non-uniformity of the exposure or a variation with time in the light intensity of a light source is caused at the time of light fogging, there are disadvantages that the density of the resulting positive image tends to vary and the gradation may also change to make it difficult to obtain a good image.

SUMMARY OF THE INVENTION

This invention has been made in view of the above circumstances, and an object of this invention is to provide a direct positive light-sensitive material that contains an internal latent image type silver halide grains and can obtain a good positive image being stable to variation in fogging exposure, particularly even if subjected to development at a higher temperature.

As described in the above, the sensitivity to fogging exposure of silver halide emulsion grains (represented by $S_W$) correlates to the inherent sensitivity (corresponding to the sensitivity to image-forming exposure, and represented by $S_D$).

The present inventors have made intensive studies on the above correlation, and, as a result, obtained a new finding as explained below.

Internal latent image type silver halide grains having certain sensitivity (such a sensitivity is represented by $S_D^0$) are desensitized with use of a desensitizer (the resulting sensitivity is represented by $S_D^1$) to cause a sensitivity difference ($S_D^0 > S_D^1$), and there is the following relation between the sensitivities to fogging exposure of these undesensitized grain and desensitized grain (these sensitivities are represented by $S_W^0$ and $S_W^1$, respectively):

$$S_W^1/S_D^1 > S_W^0/S_D^0$$

This shows that the ratio of the light fogging sensitivity to the image formation sensitivity ($S_W/S_D$) increases in the desensitized grain, and further suggests that the light fogging sensitivity in the desensitized grain is improved.

This fact can not be expected at all from desensitized grains which have conventionally been known, and can be said to be a new finding ($S_D$ and $S_W$ described above are obtained according to the method described herein after).

Accordingly, the object of this invention can be achieved by a direct positive light-sensitive material having at least one silver halide emulsion layer containing at least two kinds of internal latent image type silver halide grains not previously fogged and having the same spectral sensitivity, and capable of obtaining a direct positive image by effecting surface development while applying and/or after applying whole areal exposure after image exposure; wherein said internal latent image type silver halide grains have different sensitivity from each other and at least one of silver halide grains having lower sensitivity is desensitized with use of an organic or inorganic desensitizer.

DESCRIPTION OF THE PREFERRED EMBODIMENTS

The sensitivity difference of the silver halide emulsion grains having different sensitivity from each other in this invention may be 0.2 or more in terms of the log E unit. These emulsions may be mixed and coated on a support or may be coated on different layers, respectively.

The silver halide grains having different sensitivity from each other may also be same grain size or different one, and may preferably have an average grain size in the range of from 0.2 to 1.2 μm.

In case where silver halide grains having different size are employed, the grain size ratio of the lower sensitivity grains desensitized by use of a desensitizer to the grain size of the higher sensitivity grains is 7:10 or more, preferably 12:10 or less, more preferably less than 10:10, and the proportion of the desensitized grains to the total grains is preferably in the range of from 1:9 to 9;1, more preferably in the range of from 2:8 to 7:3.

In this invention, the desensitizer used in a lower sensitivity emulsion layer includes inorganic desensitizers such as rhodium salts, bismuth salts, lead salts and copper salts, and organic desensitizers such as pinakryptol, phenosafranine and other desensitizing dyes described in RD No. 17643, Section IV.

Examples of the inorganic desensitizers may include rhodium chloride ($RhCl_3$), sodium chlororhodate ($Na_3RhCl_6$), potassium bromorhodate ($K_3RhBr_6$), bismuth nitrate [$Bi(NO_3)_3$, lead nitrate [$Pb(NO_3)_2$], Copper sulfate ($CuSO_4$), cupric chloride ($CuCl_2$), etc. Among these, preferred are water-soluble rhodium salts.

As for the addition time of these desensitizers, in case of the inorganic desensitizers, they may preferably be added before completion of the first ripening at the time of the preparation of emulsions, and in case of the organic desensitizers, they may preferably be added at any time of the preparation of emulsions, i.e., at any time before completion of the first ripening or any time after completion of the ripening to any appropriate time before coating.

In the case of the inorganic desensitizers, they may be added suitably in an amount of $10^{-9}$ to $10^{-5}$ mol, particularly preferably $10^{-8}$ to $10^{-6}$ mol, per mol of silver. In the case of the organic desensitizers, they may be added preferably in the range of $10^{-6}$ to $10^{-2}$, particularly $10^{-5}$ to $10^{-3}$ mol, per mol of silver.

In this invention, what is meant by "not previously fogged" is that the density obtained when a test piece prepared by coating a transparent support with the emulsion used in this invention to have an amount of 35 mg Ag/cm$^2$ is developed for 10 minutes at 20° C. in the absence of exposure and with use of surface developing solution shown below, is not more than 0.6, preferably not more than 0.4.

| Surface developing solution A: | |
|---|---|
| Methol | 2.5 g |
| L-ascorbic acid | 10 g |
| Sodium metaborate (tetrahydrate) | 35 g |
| Potassium bromide | 1 g |
| Made up to 1 liter by adding water. | |

The internal latent type silver halide emulsion according to this invention is one capable of forming latent images predominantly inside silver halide grains and containing silver halide grains having most of sensitive nuclei in the interior of the grains and further capable of giving a sufficient density when the test piece prepared in the manner as above is exposed to light and thereafter developed with use of internal developing solution B shown below.

| Internal developing solution B: | |
|---|---|
| Methol | 2.0 g |
| Sodium sulfite (anhydrous) | 90.0 g |
| Hydroquinone | 8.0 g |
| Sodium carbonate (monohydrate) | 52.5 g |
| Potassium bromide | 5.0 g |
| Potassium iodide | 0.5 g |
| Made up to 1 liter by adding water | |

More specifically describing, it is an emulsion capable of showing, when a part of the above test piece is exposed to light in the light intensity scale over a given period not longer than about 1 second and developed for 10 minutes at 20° C. with use of internal developing solution B, a maximum density at least 5 times, preferably at least 10 times, as compared with the density obtained when another part of the above test piece exposed to light under the same conditions and developed for 10 minutes at 20° C. with use of internal developing solution A.

Although various kinds of internal latent type silver halide emulsion can be used in this invention, the so-called core/shell type grain emulsion comprising a core and a shell covering the core can be preferably used.

Silver halides of the core grain preferably comprise mainly silver bromide, and may further contain silver chloride and/more silver iodobromide. Silver halide grain constituting the core may take any shape, as exemplified by hexahedral, octahedral, dodecahedral or a mixed shape thereof, or alternatively spheric, plane or amorphous grains. Although the average size and the size distribution of the silver halide grains constituting the core of this invention may widely be varied depending on the desired photographic performance, the narrower size distribution is preferred. Namely, it is preferable that the silver halide grains constituting the core of this invention is substantially mono-dispersed.

The core grains may be any one in which chemical sensitization or doping with a metal ion is applied, or alternatively both of or none of treatments described above are applied.

Various methods for the chemical sensitization have been known, as exemplified by sulfur sensitization, gold sensitization, reduction sensitization, noble metal sensitization and combination of these.

As described above, the core may be one in which treatment such as the above mentioned chemical sensitization treatment or doping with a metal ion are not applied. In this case, the core is supposed to form a sensitive nuclei caused by a crystalline disorder on the interface of the core and the shell during covering of the core with the shell. In this regard, reference can be made to the descriptions in U.S. Pat. No. 3,935,014 and No. 3,957,488.

As a method to form a shell on a core, the double jet method or premixing method can be employed. Alternatively, it can also be formed according to the Ostwald ripening by mixing silver halide fine grains with a core emulsion.

The shell may be composed of a single-layer or a multi-layers comprising two or more layers.

The multi-layered shell comprises at least one of the outermost layer and layers adjacent thereto, and may have a layered structure containing different silver halide composition from each other.

Also, the multi-layered shell may have a structure in which the silver halide composition varies continuously in direction of the radius of the grain.

Further it is preferable that the outermost layer or the surface portion of the shell located on the outermost position contains silver chloride, and in this case any silver halide composition may be employed so long as the shell contains substantially silver chloride. The silver halide may include, for example, silver chloride, silver chlorobromide, silver chloroiodide and silver chlorobromoiodide. In this case, the content of silver chloride in the shell is preferably 30 mol % or more based on the total amount of silver halide in the shell. Any ratio of the core to the shell may be employed, and the content of silver chloride contained in the core/shell grains is preferably 20 mol % or more based on the total amount of silver halide.

The silver halide emulsion according to this invention can be optically sensitized by sensitizing dyes usually used. Combination of sensitizing dyes used in supersensitization of internal latent image type silver halide emulsions and negative type silver halide emulsions is also useful for the silver halide emulsion of this invention. Regarding the sensitizing dyes, reference may be made to RD—No. 15162 and No. 17643.

The light-sensitive photographic material of this invention may be imagewise exposed (image formation) according to a usual method, followed by surface development to obtain a direct positive image with ease. More specifically, the main steps for producing the direct positive image comprises carrying out the surface development while applying and/or after applying a treatment of forming fog nuclei, i.e., the fogging treatment, by an optical action, after the present internal latent image type light-sensitive material not previously fogged, of this invention is imagewise exposed. Here, the fogging treatment is carried out by subjecting overall light-exposure. In this invention, the overall exposure is carried out by subjecting an imagewise exposed light-sensitive material to overall uniform exposure to light after it has been immersed in or wetted with a developing solution or other aqueous solutions. The light source used here may be any light so long as its wavelength falls in the region in which the light-sensitive photographic materials can be light-sensitive. For example, a high-irradiance light such as flash light can be also used by irradiating it for a short time, or alternatively a low-irradiance light may be used by irradiating it for a long time. The time for the overall uniform exposure can be changed depending on the light-sensitive photographic materials, development processing conditions, types of light sources to be used, etc. in a wide range so that a best positive image can be finally obtained.

This surface development processing is meant to be the processing with a developing solution containing substantially no silver halide solvent.

Developing agents that can be used in the surface developing solution used in the development of the light-sensitive material of this invention include usual silver halide developing agents, for example, polyhydroxybenzenes such as hydroquinone, aminophenols, 3-pyrazolidones, ascorbic acid and derivatives thereof, reductones, phenylenediamines, etc. or a mixture of any of these. Specifically, they may include hydroquinone, aminophenol, N-methylaminophenol, 1-phenyl-3-pyrazolidone, 1-phenyl-4,4-dimethyl-3-pyrazolidone, 1-phenyl-4-methyl-4-hydroxymethyl-3-pyrazolidone, ascorbic acid, N,N-diethyl-p-phenylenediamine, diethylamino-o-toluidine, 4-amino-3-methyl-N-ethyl-N-(β-methanesulfonamidoethyl)aniline, 4-amino-3-methyl-N-ethyl-N-(β-hydroxyethyl)aniline, etc. These developing agents may also be previously contained in the light-sensitive material and may be made to act on silver halides by immersing the light-sensitive material in an aqueous high pH solution.

The developing solution used in this invention may further contain particular antifoggants and development restrainers, or these additives for the developing solution may also be optionally incorporated in a layer or layers of the light-sensitive material. Usually, useful antifoggants include benzotriazoles, benzothiazoles, benzimidazoles, etc. The developing solution may also contain development accelerators, for example, polyalkylene oxide derivatives, quaternary ammonium salt compounds, etc.

In the silver halide emulsion according to this invention, all kinds of photographic additives such as wetting agents, film property improvers and coating auxiliaries can be added depending on the purpose. The wetting agents may include, for example, dihydroxy alkane, etc., the film property improvers may include water-dispersible finely particulate polymeric substances obtained by emulsion polymerization of, for example, a copolymer of alkyl acrylate or alkyl methacrylate with acrylic acid or methacrylic acid, a styrene/maleic acid copolymer, a styrene/maleic anhydride half alkyl ester copolymer or the like, and the coating aids may include, for example, saponin, polyethylene glycol lauryl ether, etc. As other photographic additives, there can be also used gelatin plasticizers, surface active agents, ultraviolet absorbents, pH adjusters, antioxidants, antistatic agents, thickeners, graininess improvers, dyes, mordants, brightening agents, development speed controllers, matting agents, etc. The silver halide emulsion prepared in the above manner may be coated on a support through the interposition of a subbing layer, an anti-halation layer, a filter layer, etc. as necessary to obtain the internal latent image type light-sensitive material of this invention.

It is useful to put the light-sensitive material used in this invention into use for color photography. In such an instance, the silver halide photographic emulsion may preferably contain cyan, magenta and yellow dye forming couplers. As the couplers, those usually used can be used.

In order to prevent the color-fading of dye images which is due to active rays having a short wavelength, it is useful to use ultraviolet absorbents, for example, thiazolidone, benzotriazole, acrylonitrile or benzophenone compounds, and particularly advantageous is to use Tinuvin PS, 320, 326, 327 or 328 (all available from Ciba-Geigy Ag.) solely or in combination.

Any materials can be used as the support for the light-sensitive material used in this invention, and the support may typically include polyethylene terephthalate films, polycarbonate films, polystyrene films, polypropylene films, cellulose acetate films, glass, baryta paper, polyethylene-laminated paper, etc. which may be optionally subjected to subbing.

The light-sensitive material used in this invention may contain, in addition to the gelatin, suitable gelatin derivatives as protective colloids or bonding agents (binders) depending on the purpose. This suitable gelatin derivatives may include, for example, acylated gelatin, guanidylated gelatin, carbamylated gelatin, cyanoethanolated gelatin, esterified gelatin, etc.

In this invention, other hydrophilic binders may be also contained depending on the purpose, including dextran, cellulose derivatives such as cellulose acetate hydrolyzed to the acetyl content of 10 to 20%, polyacrylamide, polyvinyl alcohol, polyvinyl pyrrolidone, hydrolyzed polyvinyl acetate, polyvinyl pyridine, polyvinylamine, polyaminoethyl methacrylate, polyethyleneimine, etc., which can be added in photographic component layers of the light-sensitive material such as an emulsion layer, an intermediate layer, a protective layer, a filter layer and a backing layer depending on the purpose. The above hydrophilic binders may further contain suitable plasticizers, lubricants, etc. depending on the purpose.

The photographic component layers of the light-sensitive material used in this invention can be hardened with use of any suitable hardening agents. These hardening agents may include chromium salt, zirconium salts, aldehyde type such as formaldehyde and mucohalogen acid, and halo-triazine type, polyepoxy compound, ethyleneimine type, vinylsulfone type or acryloyl type hardening agents.

The light-sensitive material used in this invention has at least one light-sensitive emulsion layer containing the internal latent image type silver halide grains according to this invention, and, in addition thereto, there can be provided with a number of various photographic component layers such as a filter layer, an intermediate layer, a protective layer, a subbing layer, a backing layer and an anti-halation layer.

In an instance where the light-sensitive photographic material of this invention is used as full color photography, at least one red-sensitive silver halide emulsion layer, at least one green-sensitive silver halide emulsion layer and at least one blue-sensitive silver halide emulsion layer are provided on the support by coating. Here, at least one light-sensitive silver halide emulsion layer may contain the internal latent image type silver halide grains according to this invention, but preferably all of the light-sensitive silver halide emulsion layers contain the internal latent image type silver halide grains according to this invention. Also, the respective light-sensitive silver halide emulsion layers may be same color sensitivity layers, or may be separated into two or more layers having different sensitivity. In this instance, at least one same spectral sensitivity layer of lower sensitivity may contain the internal latent image type silver halide grains, but preferably all of the emulsion layers contain the internal latent image type silver halide grains of this invention.

The light-sensitive material used in this invention can be effectively applied in various uses such as general black and white photography, X-ray photography, color photography, false color photography, printing, infrared photography, microphotography, and a silver dye bleach process. It can also be applied in the colloid transfer process, the color image transfer process as described in Roger's U.S. Pat. Nos. 3,087,817, 3,185,567 and 2,983,606, Wayartz et al's U.S. Pat. No. 3,253,915, Whitemore et al's U.S. Pat. No. 3,227,550, Pearl et al's U.S. Pat. No. 3,227,551, Whitemore's U.S. Pat. No. 3,227,552, and Land et al's U.S. Pat. Nos. 3,415,644, 3,415,645 and 3,415,646., the color diffusion transfer process, the absorption transfer process, etc.

As described in the above, a direct positive image stable to the variation in the fogging exposure can be obtained by using the direct positive light-sensitive material of this invention. The effect of this invention can be exhibited remarkably when the development is carried out in a short time and at a high temperature of 30° C. or more.

This invention will be specifically described below by giving Examples, but the working embodiments of this invention are by no means limited by these.

EXAMPLE 1

An aqueous solution of silver nitrate and an aqueous solution of potassium bromide in an equimolar amount were simultaneously added in an aqueous gelatin solution according to the double jet method over a period of about 50 minutes at 50° C. to obtain an emulsion comprising cubic silver bromide grains having an average grains size of 0.5 μm. In this emulsion, an aqueous solution of silver nitrate and an aqueous solution of sodium chloride/potassium bromide mixture (molar ratio: 1:1) were further simultaneously added to prepare a cubic core/shell emulsion A comprising a silver bromide core and a silver chlorobromide shell, each having an average grain size of 0.6 μm.

Emulsion B was prepared in the similar manner. More specifically, an aqueous solution of silver nitrate and an aqueous solution of sodium chloride/potassium bromide mixture (molar ratio: 1:1) were further simultaneously added onto silver bromide grains having an average grain size of 0.3 μm obtained by simultaneously adding an aqueous solution of silver nitrate and an aqueous solution of potassium bromide, thus allowing silver chlorobromide to grow to obtain the emulsion comprising core/shell grains having an average grain size of 0.4 μm.

Next, emulsion C having an average grain size of 0.6 μm was prepared in the entirely same manner as above except that $10^{-7}$ mol, per mol of silver, of sodium hexachlororhodate ($Na_3RhCl_6$) was further contained in the aqueous solution of sodium chloride/potassium bromide mixture in Emulsion A.

Emulsion D was also obtained by adding $10^{-3}$ mol, per mol of silver, of pinakriptol yellow into emulsion A as a desensitizer.

In emulsions A, B, C and D obtained above, spreading agents and hardening agents which are conventionally used were respectively added and thereafter the thus obtained emulsion was coated on a resin-coated paper support to have a silver amount of 35 mg/100 $cm^2$, followed by drying to produce four kinds of direct positive light-sensitive materials, samples 1, 2, 3 and 4.

The resulting samples were exposed to light through an wedge for use in sensitometry (hereinafter called "wedge exposure") with use of a sensitometer, and developed for 4 minutes 30 seconds at 20° C. using a developing solution formulated as follows (development 1):

| | |
|---|---|
| 1-Phenyl-3-pyrazolidone | 0.4 g |
| Sodium sulfite (anhydrous) | 75 g |
| Hydroquinone | 12 g |
| Sodium carbonate (monohydrate) | 40 g |
| Sodium hydroxide | 4 g |
| Potassium bromide | 4 g |
| 5-Methylbenzotriazole | 10 mg |
| Made up to 1 liter by adding water. | |

Here overall uniform exposure was effected using white light of 1 lux for 10 seconds after 20 seconds from start of development. As a result, positive images are obtained from all of the samples. The sensitivity ($S_D$) is represented by a relative value (assuming the sensitivity of sample 1 as 100) of a reciprocal of the exposure amount required for giving the following value.

$$\frac{\text{maximum density} + \text{minimum density}}{2}$$

Results obtained are shown in Table 1.

Next, the respective samples were dipped in the above developing solution for 20 seconds. Thereafter, they were taken out therefrom and the thus wetted samples were exposed to light for 10 seconds through an wedge with use of white light for 1 lux, which were again returned in the developing solution to carry out development for 4 minutes at 20° C. (development 2). The images thus obtained were all negative images. The sensitivity ($S_W$) is represented by a relative value (assuming the sensitivity of sample 1 as 100) of a reciprocal of the exposure amount required for giving the density of minimum density+0.1. Results obtained are shown together in Table 1.

TABLE 1

| Sample No. | Emulsion | Relative sensitivity $S_D$ | Relative sensitivity $S_W$ | $S_W/S_D$ |
|---|---|---|---|---|
| 1 | A | 100 | 100 | 1.0 |
| 2 | B | 27 | 23 | 0.85 |
| 3 | C | 21 | 65 | 3.1 |
| 4 | D | 25 | 43 | 1.7 |

It is understood from Table 1 that assuming emulsion A as a standard, the sensitivities ($S_D$ and $S_W$) are both lowered in the sample in which the grains were made smaller (emulsion B) and the samples in which the emulsions were desensitized by using desensitizers (emulsions C and D), but, as will be clear from the sensitivity ratio ($S_W/S_D$), the sensitivity to fogging exposure of emulsion C or D is in an increased level.

EXAMPLE 2

Emulsion A and emulsion B prepared in Example 1 were mixed in the proportion of 2:1 to prepare emulsion E, and similarly, emulsion A and emulsion C prepared in Reference Example were mixed in the proportion of 2:1 to prepare emulsion F.

In each of emulsion E and emulsion F, a sensitizing dye anhydro-9-ethyl-3,3'-di(3-sulfobutyl)-5,5'-diphenyloxacarbocyanine hydroxide was added to effect spectral sensitization. Separately, 1-(2,4,6-trichlorophenyl)-3-(2-chloro-5-octadecylsuccinimidoanilino)-5-pyrazolone as a magenta coupler was dissolved in a mixed solvent of dibutyl phthalate and ethyl acetate, and dispersed in an aqueous gelatin solution to prepare an emulsified solution, which was added and mixed in each of the above spectrally sensitized emulsions. After a hardening agent was added in this two emulsions, the emulsions each were coated on a resin-coated paper support so as to give a silver amount of 5 mg/100 $cm^2$, followed by drying to produce samples 5 and 6.

These samples were subjected to wedge exposure through a yellow filter, and developed for 4 minutes 30 seconds at 28° C. (development 3), 3 minutes 30 seconds at 33° C. (development 4) or 2 minutes 30 seconds at 38° C. (development 5), respectively, with use of a developing solution formulated as follows:

| | |
|---|---|
| 4-Amino-3-methyl-N-ethyl-N-(β-methane sulfonamidoethyl)aniline sulfate | 5 g |
| Sodium sulfite (anhydrous) | 2 g |
| Sodium carbonate (monohydrate) | 15 g |
| Sodium bromide | 1 g |
| Benzyl alcohol | 10 ml |
| Made up to 1 liter by adding water. (Adjusted to pH 10.2 using potassium hydroxide.) | |

Uniform exposure was overall effected using white light for 10 seconds after 20 seconds from start of development, with the exposure amount as shown in Table 2 (where the irradiance was varied to four stages). Subsequently, bleach-fixing and washing were carried out according to a conventional method, followed by drying. Table 2 shows the results of measurement of the maximum density and minimum density of the magenta positive image obtained by each development processing.

TABLE 2

| Sample | Emulsion | Development condition | Minimum density Fogging exposure amount (CMS) 2 | 5 | 10 | 20 | Maximum density Fogging exposure amount (CMS) 2 | 5 | 10 | 20 |
|---|---|---|---|---|---|---|---|---|---|---|
| 5 (Comparative) | E | Development-3 | 0.05 | 0.06 | 0.06 | 0.07 | 1.67 | 1.80 | 1.89 | 1.93 |
| | | Development-4 | 0.05 | 0.05 | 0.06 | 0.07 | 1.46 | 1.68 | 1.86 | 1.94 |
| | | Development-5 | 0.05 | 0.05 | 0.06 | 0.07 | 1.32 | 1.60 | 1.81 | 1.91 |
| 6 (Present invention) | F | Development-3 | 0.05 | 0.05 | 0.05 | 0.06 | 1.83 | 1.87 | 1.88 | 1.90 |
| | | Development-4 | 0.05 | 0.05 | 0.05 | 0.06 | 1.82 | 1.86 | 1.89 | 1.91 |
| | | Development-5 | 0.05 | 0.05 | 0.05 | 0.06 | 1.80 | 1.85 | 1.87 | 1.89 |

As shown in Table 2, sample 6 of this invention can obtain a stable and good positive image that may suffer less variation of the maximum density even if the fogging exposure amount varies. Particularly when the development was carried out in a short time at a higher temperature of 30° C. or more, the density of a lower irradiance (small exposure amount) is extremely lowered in comparative sample 5, while in sample 6, a density that can sufficiently withstand the practical applications can be obtained.

EXAMPLE 3

An aqueous solution of silver nitrate and an aqueous solution of potassium bromide in an equimolar amount were simultaneously added in an aqueous gelatin solution according to the double jet method over a period of about 50 minutes at 50° C. to form tetradecahedral silver bromide grains having an average grain size of 0.4 μm, followed by further simultaneous addition of an aqueous solution of silver nitrate and an aqueous solution of sodium chloride to prepare emulsion G comprising cubic core/shell type grains comprising a silver bromide core and a silver chloride shell and having an average grain size of 0.6 μm.

In the same manner as for emulsion G, silver bromide grains having an averge grain size of 0.3 μm were formed, to which an aqueous solution of silver nitrate and an aqueous solution of sodium chloride containing $5\times10^{-8}$ mol, per mol of silver, of sodium hexachlororhodate were simultaneously added, thus further allowing grains to grow to obtain a low speed emulsion H comprising core/shell type grains having an average grain size of 0.45 μm. Next, into each of emulsions obtained by mixing emulsion G and emulsion H in the proportion shown below, a sensitizing dye anhydro-9-ethyl-3,3'-di(3-sulfopropyl)-5,5'-dichlorothiacarbocyanine hydroxide was added to effect spectral sensitization. Separately, 2,4-dichloro-3-methyl-6-[2-(2,4-di-t-amylphenoxy)butylamido]phenol as a cyan coupler was dissolved in a mixed solvent of dibutyl phthalate and ethyl acetate, and dispersed in an aqueous gelatin solution to prepare an emulsified solution, which was added and mixed in each of the above spectrally sensitized emulsions. After a hardening agent was added in these emulsions, the emulsions of each were coated on a resin-coated paper support so as to give a silver amount of 4 mg/100 $cm^2$, followed by drying to produce samples 7, 8 and 9.

TABLE

| | Emulsion G | Emulsion H |
|---|---|---|
| Sample 7 | 7 | 3 |
| Sample 8 | 5 | 5 |
| Sample 9 | 4 | 6 |

These samples were subjected to wedge exposure through a red filter, and developed for 2 minutes 30 seconds at 38° C. with use of a developing solution formulated as follows:

| | |
|---|---|
| 4-Amino-3-methyl-N-ethyl-N-β-methanesulfonamidoethyl)aniline sulfate | 5 g |
| Sodium sulfite (anhydrous) | 0.3 g |
| Sodium carbonate (monohydrate) | 15 g |
| Sodium bromide | 0.3 g |
| Made up to 1 liter by adding water. (Adjusted to pH 10.2 using sodium hydroxide.) | |

Uniform exposure was overall effected for 10 seconds after 20 seconds from start of development, by varying irradiance in the same manner as in Example 2. Subsequently, bleach-fixing and washing were carried out according to a conventional method, followed by drying.

Table 3 shows the results of measurement of the maximum density and minimum density of the cyan positive image obtained by each development processing.

TABLE 3

| Sample | Emulsion G/Emulsion H | Maximum density/minimum density Fogging exposure amount (CMS) 2 | 5 | 10 | 20 |
|---|---|---|---|---|---|
| 7 | 7:3 | 1.75/0.05 | 1.79/0.05 | 1.80/0.05 | 1.82/0.06 |
| 8 | 5:5 | 1.82/0.05 | 1.86/0.05 | 1.88/0.05 | 1.91/0.06 |
| 9 | 4:6 | 1.90/0.05 | 1.95/0.05 | 1.96/0.05 | 1.98/0.06 |

As will be clear from Table 3, the light-sensitive material of this invention can give good positive images in any mixing ratio.

EXAMPLE 4

To emulsion A, emulsion B and emulsion C prepared in Example 1 was added and mixed a emulsified liquior of oil-protectedly dispersed α-[4-(1-benzyl-2-phenyl-3,5-dioxo-1,2,4-triazolydinyl)]-α-pivalyl-2-chloro-5-[γ-(2,4-di-tert-amylphenoxy)butylamido]acetoanilide which is a yellow coupler, and further added a hardening agent, to prepare emulsion (A), (B) and (C). Subsequently, emulsion (B) was coated on a resin-coated paper support so as to give a silver amount of 5 mg/100 $cm^2$, followed by coating of an aqueous gelatin solution to provide an intermediate layer, and then emulsion (A) was coated thereon so as to give a silver amount of 5 mg/100 $cm^2$ to prepare sample 10.

Sample 11 was prepared in the same manner as in sample 10, except that emulsion (C) was used in place of emulsion (B).

These samples were subjected to wedge exposure using white light, and developed for 2 minutes 30 seconds at 38° C. with use of the developing solution used in Example 2.

Overall exposure was effected uniformly for 10 seconds after 20 seconds from start of development by varying irradiance in the same manner as in Example 2. Subsequently, bleach-fixing and washing were carried out according to a conventional method, followed by drying.

Table 4 shows the results of measurement of the maximum density and minimum density of yellow positive image obtained by each development processing.

TABLE 4

| Sample | Maximum density/minimum density Fogging exposure amount (CMS) 2 | 5 | 10 | 20 |
|---|---|---|---|---|
| 10 (Comparative) | 1.21/0.05 | 1.53/0.05 | 1.84/0.06 | 1.95/0.06 |
| 11 (Present invention) | 1.82/0.05 | 1.86/0.05 | 1.87/0.05 | 1.88/0.06 |

As will be clear from Table 4, also in the multilayer-coated sample, the light-sensitive material of this invention can give a stable and good positive images even if the fogging exposure amount varies.

EXAMPLE 5

Emulsion A and emulsion C prepared in Example 1 were mixed in the proportion of 1:1 to prepare emulsion I.

The thus obtained emulsion I was divided into three portions and one of them was subjected to spectral sensitization by use of anhydro-9-ethyl-3,3'-di(3-sulfopropyl)-5,5-dichlorothiacarbocyanine hydroxide to prepare a red-sensitive emulsion, the second portion of them was subjected to spectral sensitization with use of anhydro-9-ethyl-3,3'-di(3-sulfopropyl)-5,5-diphenylloxacarbocyanine hydroxide to prepare a green-sensitive emulsion, and the third portion of them was subjected to spectral sensitization with use of anhydro-3-sulfopropyl-3'-carboxymethyl-5,5'-cyclothiacyanine hydroxide to prepare a blue-sensitive emulsion.

On resin-coated paper support, the following layers were coated successively in this order.

(1) Red sensitive emulsion layer

The above described red sensitive emulsion (5 mg/$dm^2$ in terms of silver) and 2,4-dichloro-3-methyl-6-[α-(2,4-di-tert-amylphenoxy)butylamido]phenol (0.45 mol per mol of silver halide) which is a oil-protectedly dispersed cyan coupler are contained.

(2) Intermediate layer 2,5-Di-tert-octylhydroquinone which is oil-protectedly dispersed is contained.

(3) Green sensitive emulsion

The above described green sensitive emulsion (5 mg/$dm^2$ in terms of silver) and 1-(2,4,6-trichlorophenyl)-3-(2-chloro-5-octadecylsuccineimidoanilino)-5-pyrazolone (0.25 mol per mol of silver halide) which is an oil-protectedly dispersed magenta coupler are contained.

(4) Yellow filter layer

Yellow colloid silver and oil-protectedly dispersed 2,5-di-tert-octylhydroquinone are contained.

(5) Blue sensitive emulsion

The above described blue sensitive emulsion (6 mg/$dm^2$ in terms of silver) and α-[4-(1-benzyl-2-phenyl-3,5-dioxo-1,2,4-triazolidinyl)]-α-pyvalyl-2-chloro-5-[γ-(2,4-di-tert-amylphenoxy)butylamido]acetonitrile (0.45 mol per mol of silver halide) which is an oil-protectedly dispersed yellow coupler are contained.

(6) Protective layer

Gelatin layer.

The dried samples thus obtained were subjected to wedge exposure using white light, and developed for 2 minutes 50 seconds at 38° C. with use of a developing solution used in Example 2. Overall fogging exposure was uniformly effected using white light for 10 seconds after 10 seconds from start of development, by varying irradiance in the same manner as in Example 2. Subsequently, bleach-fixing and washing treatment were carried out. From the results obtained, it was found that a stable and good posi image can be obtained even if the fogging exposure amount varies.

We claim:

1. A direct positive light-sensitive silver halide photographic material comprising at least one silver halide emulsion layer containing at least two kinds of internal latent image type silver halide grains not previously fogged and having the same spectral sensitivity, and capable of obtaining a direct positive image by effecting surface development while applying and/or after applying overall exposure after imagewise exposure, wherein said at least two kinds of internal latent image type silver halide grains have different sensitivity from each other and at least one silver halide grain having a lower sensitivity is desensitized by an organic or inorganic desensitizer.

2. The photographic material according to claim 1, wherein said material is capable of forming a good positive image at a higher temperature.

3. The photographic material according to claim 2, wherein said high temperature is 30° C. or more.

4. The photographic material according to claim 1, wherein said densitizer is organic.

5. The photographic material according to claim 1, wherein said desensitizer is inorganic.

6. The photographic material according to claim 5, wherein said inorganic desensitizer is a water-soluble rhodium salt.

7. The photographic material according to claim 4, wherein said organic desensitizer is added in an amount of from $10^{-6}$ to $10^{-2}$ mol per mole of silver.

8. The photographic material according to claim 7, wherein said organic desensitizer is added in an amount of from $10^{-5}$ to $10^{-3}$ mol per mol of silver.

9. The photographic material according to claim 5, wherein said inorganic desensitizer is added in an amount of from $10^{-9}$ to $10^{-5}$ mol per mol of silver.

10. The photographic material according to claim 9 wherein said inorganic desensitizer is added in an amount of from $10^{-8}$ to $10^{-6}$ mol per mol of silver.

11. The photographic material according to claim 5 wherein said inorganic desensitizer is added before completion of the first ripening.

12. The photographic material according to claim 5 wherein said inorganic desensitizer is added during formation of grains.

13. The photographic material according to claim 1, wherein the difference in sensitivities of said silver halide grains having different sensitivity from each other is 0.2 or more in terms of the log E unit.

14. The photographic material according to claim 1, wherein grain size of said silver halide grains having different sensitivity from each other is in the range of from 0.2 to 1.2 μm.

15. The photographic material according to claim 1, wherein the proportion of said lower sensitivity grains to the total grains is in the range of from 1:9 to 9:1.

16. The photographic material according to claim 15, wherein the proportion of said lower sensitivity grains to the total grains is in the range of from 2:8 to 7:3.

17. The photographic material according to claim 1, wherein the grain size ratio of said lower sensitivity grains to said higher sensitivity grains is 7:10 or more.

18. The photographic material according to claim 17, wherein the grain size ratio of said lower sensitivity grains to said higher sensitivity grains is 12:10 or less.

19. The photographic material according to claim 18, wherein the grain size ratio of said lower sensitivity grains to said higher sensitivity grains is 10:10 or less.

20. The photographic material according to claim 1, wherein said internal latent image type silver halide emulsion comprises core/shell type grains.

21. The photographic material according to claim 20, wherein the outermost layer of said shell contains AgCl.

22. The photographic material according to claim 21, wherein 30% or more of said shell comprise AgCl.

23. The photographic material according to claim 1, wherein 20% or more of the total grains comprise AgCl.

24. The photographic material according to claim 1, wherein said desensitizer is a water-soluble rhodium salt and is added in an amount of $10^{-9}$ to $10^{-5}$ mol per mol of silver during formation of grains.

25. The photographic material according to claim 20, wherein the difference in sensitivities of said silver halide grains having different sensitivity from each other is 0.2 or more in terms of the log E, grain size of said silver halide grains having different sensitivity from each other is in the range of from 0.2 to 1.2 μm, the grain size ratio of said lower sensitivity grains to said higher sensitivity grains is 7:10 or more and the outermost layer of said shell contains AgCl.

26. The photographic material according to claim 20, wherein said desensitizer is a water-soluble rhodium salt, the difference in sensitivities of said silver halide grains having different sensitivity from each other is 0.2 or more in terms of the log E, grain size of said silver halide grains having different sensitivity from each other is in the range of from 0.2 to 1.2 μm, the grain size ratio of said lower sensitivity grains to said higher sensitivity grains is 7:10 or more and the outermost layer of shell contains AgCl.

* * * * *